US008936523B2

(12) United States Patent
Manners et al.

(10) Patent No.: US 8,936,523 B2
(45) Date of Patent: Jan. 20, 2015

(54) TRAINING DEVICE

(71) Applicants: David W. Manners, Easton, PA (US); Michael F. Cerimele, Jr., Allentown, PA (US)

(72) Inventors: David W. Manners, Easton, PA (US); Michael F. Cerimele, Jr., Allentown, PA (US)

( * ) Notice: Subject to any disclaimer, the term of this patent is extended or adjusted under 35 U.S.C. 154(b) by 126 days.

(21) Appl. No.: 13/621,966

(22) Filed: Sep. 18, 2012

(65) Prior Publication Data

US 2014/0080637 A1 Mar. 20, 2014

(51) Int. Cl.

| | |
|---|---|
| ***A63B 69/00*** | (2006.01) |
| ***A63B 43/06*** | (2006.01) |
| *A63B 43/00* | (2006.01) |

(52) U.S. Cl.

CPC ..... *A63B 69/00* (2013.01); *A63B 43/06* (2013.01); *A63B 2243/0025* (2013.01); *A63B 69/002* (2013.01); *A63B 43/00* (2013.01)

USPC ..... 473/438; 473/422; 473/615; 473/570

(58) Field of Classification Search

CPC ..... A63B 69/00; A63B 69/002; A63B 2243/0025; A63B 43/06

USPC ..... 473/422, 438, 446, 610, 570, 571, 599, 473/597

See application file for complete search history.

(56) References Cited

U.S. PATENT DOCUMENTS

| | | | | | |
|---|---|---|---|---|---|
| 2,364,247 | A | * | 12/1944 | Shearer | 473/610 |
| 3,229,976 | A | * | 1/1966 | Allen, Jr. | 473/570 |
| 3,887,416 | A | * | 6/1975 | Tebbetts, Jr. | 156/156 |
| 4,002,893 | A | * | 1/1977 | Newcomb et al. | 473/570 |
| 4,027,879 | A | | 6/1977 | Wright | |
| 4,133,528 | A | * | 1/1979 | Koblick | 473/570 |
| 5,123,645 | A | * | 6/1992 | MacDonald et al. | 473/594 |
| 5,186,458 | A | * | 2/1993 | Redondo | 473/570 |
| 5,224,704 | A | * | 7/1993 | Snell | 473/604 |
| 5,251,903 | A | | 10/1993 | Bixler et al. | |
| 5,261,661 | A | * | 11/1993 | Lemmon | 473/438 |
| 5,322,281 | A | | 6/1994 | Ganger | |
| 5,439,217 | A | | 8/1995 | Ganger et al. | |
| 5,681,993 | A | | 10/1997 | Heitman | |
| 6,547,703 | B1 | | 4/2003 | Swezey et al. | |
| 6,663,547 | B1 | | 12/2003 | Hughes | |
| 6,700,501 | B2 | | 3/2004 | Winton | |
| 6,887,173 | B2 | * | 5/2005 | Lacroix et al. | 473/593 |
| 7,014,581 | B2 | * | 3/2006 | Ng | 473/570 |
| 7,273,431 | B2 | * | 9/2007 | DeVall | 473/570 |
| 8,128,523 | B2 | * | 3/2012 | Laliberty et al. | 473/603 |
| 2010/0267502 | A1 | | 10/2010 | Kaufman | |
| 2014/0080637 | A1 | * | 3/2014 | Manners et al. | 473/438 |

* cited by examiner

*Primary Examiner* — Mitra Aryanpour

(74) *Attorney, Agent, or Firm* — Design IP

(57) ABSTRACT

A training device is disclosed that has a depressable element and an indicator element that provides a perceivable indication, for example an audible alarm, to a user when an amount of force being applied to the training device along the major axis of the training device is less than a desired amount of depressing force. In some embodiments, the training device is in the shape of a prolate sphere and approximates the size and shape of a ball typically used in American football. The training device may be configured so that no perceivable indication is provided while either little to no force is being applied to the training device along its major axis or while an adequate amount of force is being applied to the training device along the major axis thereof.

20 Claims, 7 Drawing Sheets

TRAINING DEVICE

FIELD OF THE INVENTION

The present invention relates to the field of training devices for athletes, for example ballcarriers in American football.

BACKGROUND OF THE INVENTION

Ball security—i.e., possessing the ball so as not to commit a turnover, thereby giving possession of the ball to the opposing team—in such sports as American football and Rugby football is a critically-important factor that affects the likelihood that a team will win a game. Therefore, ballcarriers in American football, for example receivers, tight ends, running backs, and kickoff and punt returners are taught to develop secure ballhandling skills so that they minimize the likelihood that they will fumble the ball during plays, thereby reducing the likelihood of committing turnovers.

There is a need for a training device that helps ballcarriers develop more secure ballhandling technique.

BRIEF DESCRIPTION OF THE DRAWINGS

The foregoing summary, as well as the following detailed description of the invention, will be better understood when read in conjunction with the appended drawings. For the purpose of illustrating the invention disclosed herein, certain embodiments in accordance with the herein disclosed invention are shown in the drawings. It should be understood, however, that the herein disclosed invention is not limited to the precise arrangements shown. It should also be understood that, in the drawings, the parts are not necessarily drawn to scale. The present invention will hereinafter be described in conjunction with the appended drawing figures, wherein like numerals denote like elements. In the drawings.

DETAILED DESCRIPTION OF THE PREFERRED EMBODIMENTS

Figure 1:
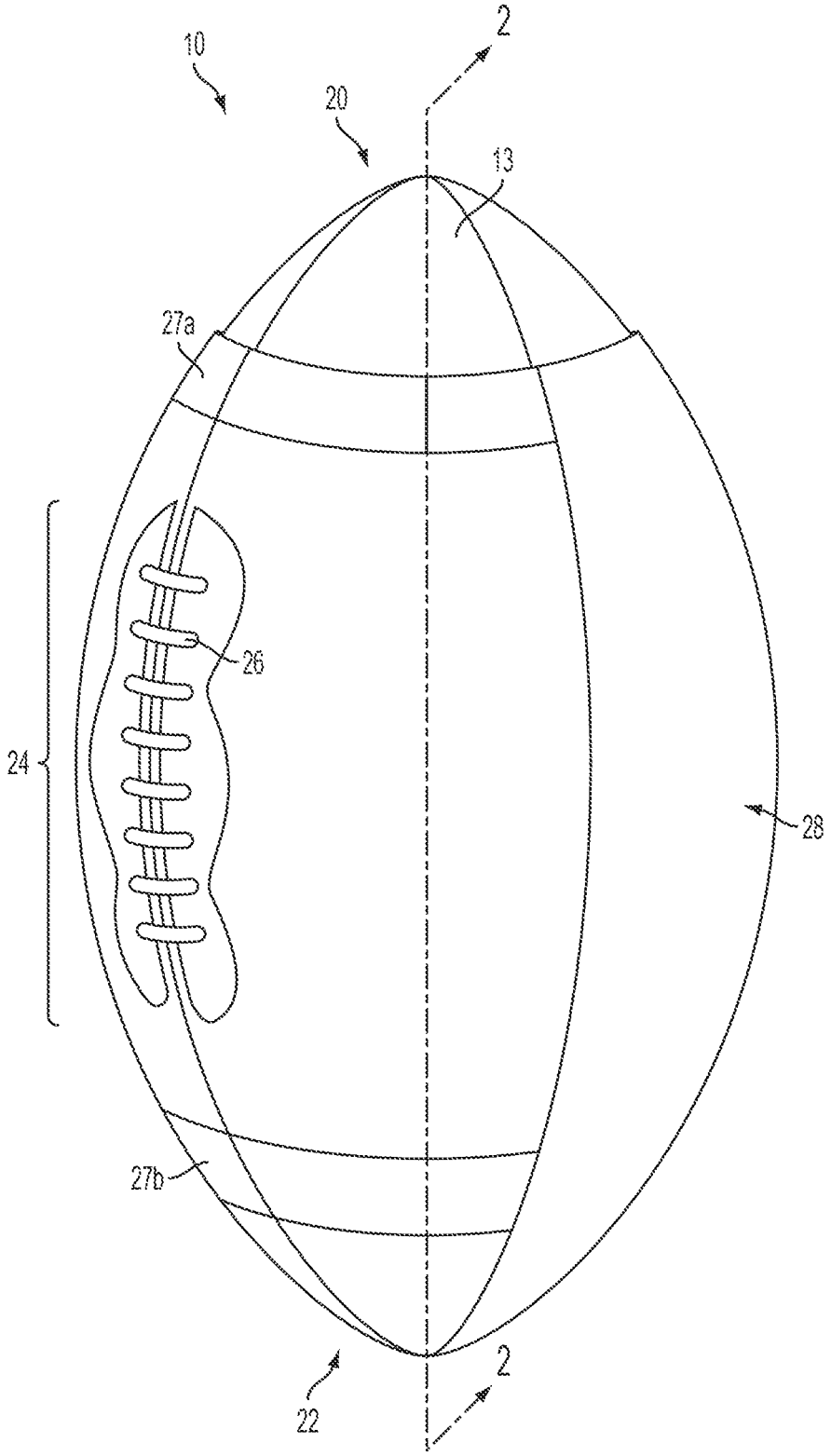
FIG. 1 shows a perspective view of an embodiment of a training device according to the present invention.

The ensuing detailed description provides preferred exemplary embodiments only, and is not intended to limit the scope, applicability, or configuration of the herein disclosed inventions. Rather, the ensuing detailed description of the preferred exemplary embodiments will provide those skilled in the art with an enabling description for implementing the preferred exemplary embodiments in accordance with the herein disclosed invention. It is understood that various changes may be made in the function and arrangement of elements without departing from the spirit and scope of the invention, as set forth in the appended claims.

To aid in describing the invention, directional terms may be used in the specification and claims to describe portions of the present invention (e.g., upper, lower, left, right, etc.). These directional definitions are merely intended to assist in describing and claiming the invention and are not intended to limit the invention in any way. In addition, reference numerals that are introduced in the specification in association with a drawing figure may be repeated in one or more subsequent figures without additional description in the specification in order to provide context for other features.

For purposes of this application and the appended claims, the term "perceivable" means detectable, identifiable, or knowable by the use of at least one of the human senses.

For purposes of this application and the appended claims, the term "approximately parallel" means within plus or minus 5 degrees from a parallel orientation.

For purposes of this application and the appended claims, the term "approximately perpendicular" means within plus or minus 5 degrees from a perpendicular orientation.

Many games use a ball that approximates the shape of a prolate spheroid, for example American, Canadian, and Australian football and rugby union and rugby league. The unique shape of the balls used in these various games makes them particularly difficult to carry. Moreover, in all of these games, ball security is of paramount importance, as turnovers caused by the ball being fumbled or swatted, poked, or jarred loose often increase the likelihood that the opposing team will win the game.

In American and Canadian football (hereinafter "football"), ballcarriers are taught from a young age the importance of ball security to a team's chances of winning a game. However, during game action, players often have a tendency to loosen their grip on the ball as they become distracted with the action unfolding around them on the playing field. Thus, there is a need for training devices that train players to maintain a strong grip on the football, in order to minimize the prevalence of fumbles and resulting turnovers.

Ball security in football is generally taught through a "three points of contact" system. In other words, ballhandlers are taught that they should establish a minimum of three points of contact between the ball and their body while they are attempting to advance the ball down the playing field. According to this system, the first point of contact is made between the ball and the ballhandler's carrying hand, which is draped over the top of a first point or "nosepiece" of the ball. The second point of contact is made between an outwardly-facing portion of a side portion or panel of the ball and the forearm of the ballcarrier's carrying arm, so that a second (opposing) nosepiece of the football sits at or near the crook of the elbow of the ballcarrying arm. The ball generally has a longitudinal or major axis, corresponding with the maximum axial length of the ball, that is measured between the first and second nosepieces of the football. When the ball is being properly carried, this major axis is arranged approximately parallel to an axis of the ballcarrier's forearm. When the second point of contact has been made, the fingers of the ballcarrying arm should be pointed at the body and the forearm should not touch the ballcarrier's body. The third point of contact is made between an inwardly-facing portion of the side portion of the ball and the ballcarrier's ribs. The elbow of the ballcarrying arm should be as close to the ballcarrier's torso as possible, in order to minimize or prevent an exposed area of the ball being visible from a position behind the ballcarrier that would provide an opposing player with a target with which to attempt to punch the ball loose. When they are making contact or anticipating making contact with another player or the ground, ballcarriers may also be coached that a fourth point of contact should be created between the ball and the off-hand (i.e., the hand of the non-ballcarrying arm).

Depending on the ballcarrier's preferences and owing to the nature of how a ballcarrier's arms tend to move as the ballcarrier is running, there may be some variability in the angle of the forearm with respect to ground level as the ball is being carried. Some ballcarriers maintain their forearm in a position that is angled in front of their torso, i.e., so that the major axis of the ball is disposed at an angle of between approximately 0 and 90 degrees with respect to the ground level, while other ballcarriers may prefer to maintain their forearm in a position such that the major axis of the ball is disposed approximately perpendicular with respect to the ground level. Regardless of a ballcarrier's particular ballcarrying style and technique, securing the ball more tightly at the first and second points of contact (i.e., approximately between the two nosepieces along the major axis of the ball) will help to reduce fumbles and resulting turnovers. The present invention addresses this issue by disclosing a training device having a depressable element and that provides a perceivable indication to the ballcarrier when the amount of force being applied to the training device along the major axis of the ball is or becomes inadequate. In addition, the device does not provide the perceivable indication when little to no force is being applied to the training device along the major axis of the ball (for example, while the training device is not being used or while it is only being held casually), or when an adequate amount of force is being applied to the training device along the major axis of the ball.

Referring generally to FIGS. 1-4, one embodiment of a training device 10 will be described in detail. In this embodiment, the body 12 is approximately in the shape of a prolate spheroid having slightly pointed ends corresponding with nosepieces 14, 16 of the device 10. In this embodiment, the body 12 is in the approximate shape of a ball commonly used in the game of American football. It should be understood that the body 12 could be provided in different shapes and sizes in order to replicate the different ball sizes used in, for example, peewee, junior, high school, collegiate, and professional leagues. The body 12 has a longitudinal or major axis 18 corresponding with a maximum axial length of the prolate spheroid. The body 12 comprises a first nosepiece 14 that is depressable and a second nosepiece 16 that is stationary, as will be described in further detail below. The first (depressable) nosepiece 14 corresponds with a first end 20 of the body 12, the second (stationary) nosepiece 16 corresponds with a second end 22 of the body 12, and a central portion 24 of the body 12 is located between the nosepieces 14, 16. In this embodiment, the body 12 is made from a plastic material, and may be made by any known plastic injection molding technique. To mimic the look and feel of an actual football, the body 12 of the device 10 may include laces 26, may be split into four equal-sized and -shaped panels (see FIG. 1), may have white stripes 27*a*, 27*b* painted on two of the panels in the vicinity of the first end 20 and second end 22 of the body, and may be provided with a pebble-grain outer surface 28 that is intended to mimic the look and feel of a leather football. In alternative embodiments, any or all of these additional features may be omitted, or the training device 10 may be provided with an external skin or encasement that mimics the look and feel of a real football in some or all of the ways discussed above. The design of the body 12 may impart a water-proof or water-resistant functionality to the device 10.

Figure 2:
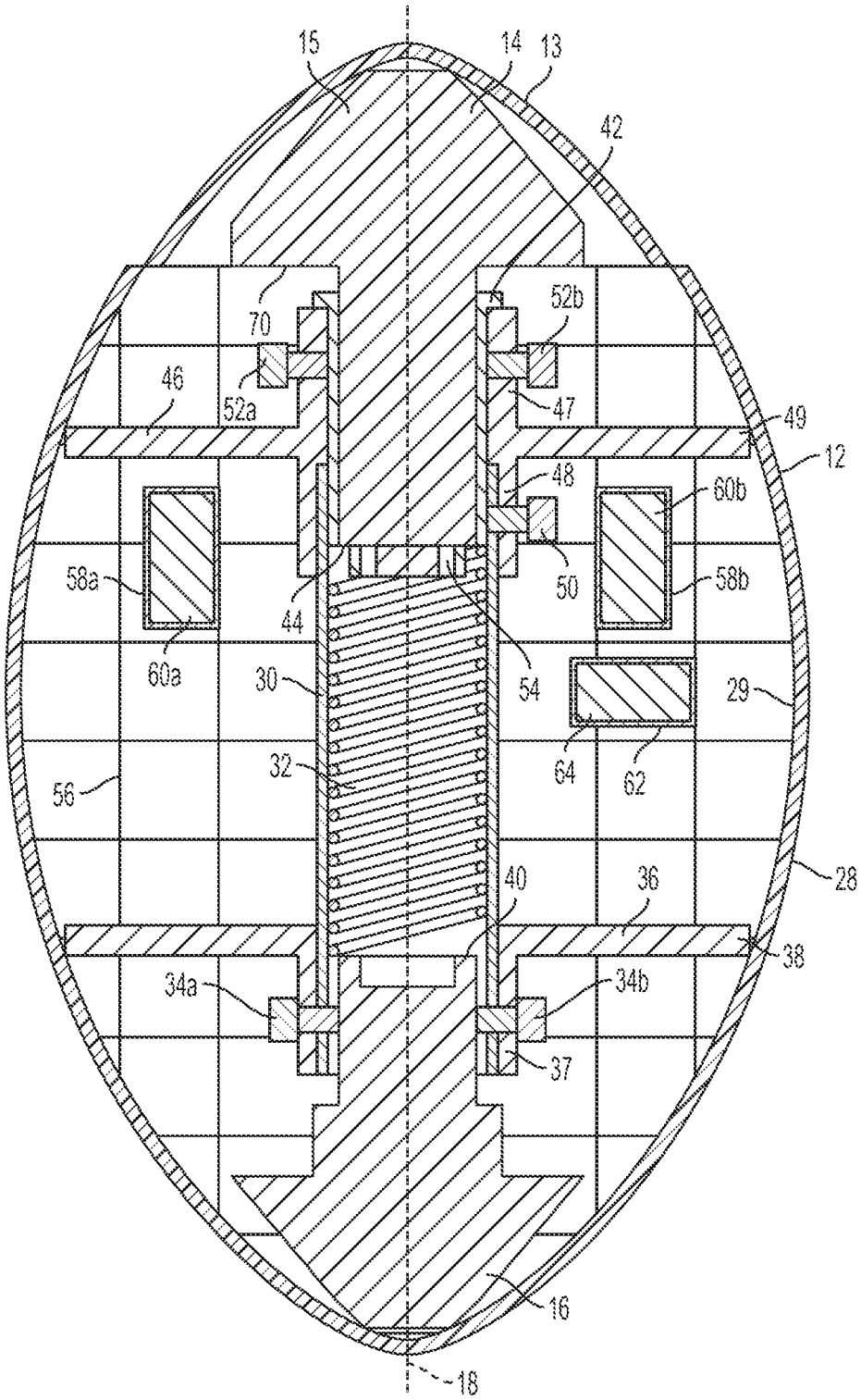
FIG. 2 shows a sectional view taken along line 2-2 of FIG. 1.
Figure 3:
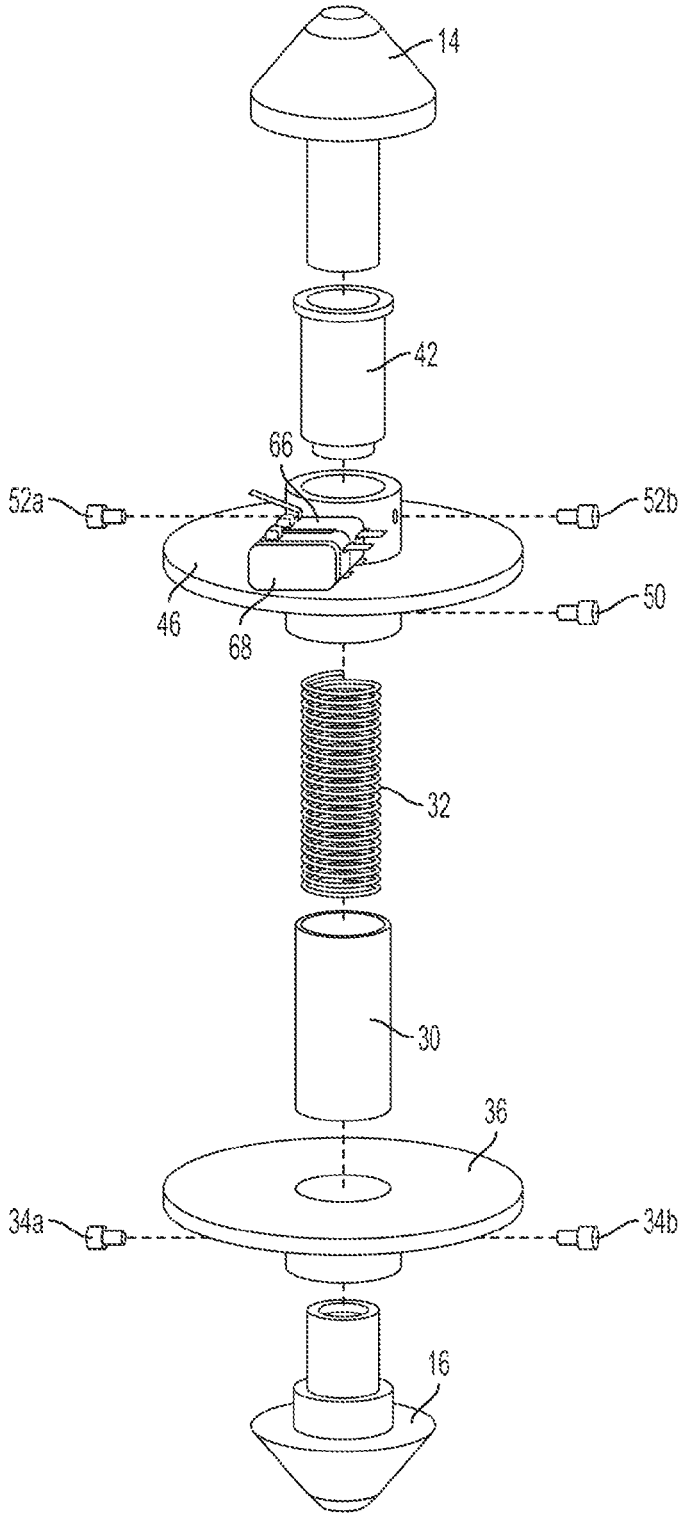
FIG. 3 shows an exploded view of some of the operative parts of the embodiment of FIG. 1.

FIG. 2 is a sectional view taken along line 2-2 of FIG. 1, and FIG. 3 is an exploded view of some of the operative parts of the interior of the body of the device 10 with the body 12 removed from view. In this embodiment, there is a spring tube 30 containing a spring 32 located on the interior of the body 12 between the nosepieces 14, 16. In this embodiment, a centerline 18 of both the spring tube 30 and the spring 32 are coaxially aligned with the major axis 18 of the body 12 and with a centerline 18 of the nosepieces. In this embodiment, the stationary nosepiece 16 is attached near the second end 22 of the body 12 to the spring tube 30 via a pair of machine screws 34*a*, 34*b* that are first passed through a collar portion 37 of a support rib 36. As shown in FIG. 2, the support rib 36 further comprises an elongated portion 38 that extends outwardly and comes into contact with an inner surface 29 of the body 12, thereby providing support for the overall shape of the body 12. The spring 32 is seated at one end against an inner surface 40 of the stationary nosepiece 16. The inner surface 40 of the stationary nosepiece 16 may have an annular-shaped groove therein (not shown) to form a spring seat so as to accommodate the end of the spring 32. In this embodiment, the spring tube 30, nosepieces 14, 16, and support ribs 36, 46 are machined from aluminum alloy type 6061-T6. In alternative embodiments, any other type of suitable material could be used for these parts within the scope of this invention.

Near the first end 20 of the body 12 of the device 10 is located the depressable nosepiece 14, which may (either alone or in combination with the spring 32) also be referred to as a depressable element. The nosepiece 14 is depressable so that it is moveable within a bushing 42. As best seen in FIGS. 1 and 2, in order to accommodate movement of the depressable nosepiece 14, the body 12 may include a moveable portion 13 that is sized and dimensioned so as to fit partially inside the body 12 when the depressable nosepiece 14 is moved. The moveable portion 13 is designed so as not to create any pinch-points at its junction with the remainder of the body 12 and to reduce or eliminate spaces between the moveable portion 13 and the remainder of the body 12 in order to minimize or prevent, for example, dust, dirt, or water from entering the interior of the body 12. In some embodiments, a flexible O-ring or seal could be provided around the interior of the moveable portion 13 in order to minimize or prevent the possibility of any substances entering the body 12. In alternate embodiments, the moveable portion 13 may be replaced with a flexible portion that is deformable to permit depression of the depressable nosepiece 14. In this embodiment, an inner surface 44 of the depressable nosepiece 14 is in contact with the other end of the spring 32, and may be likewise sized and shaped to form a spring seat to accommodate that end of the spring 32. In this embodiment, the bushing 42 is an oilite bronze bushing. It will be understood by those having ordinary skill in the art that the bushing 42 could be made from any other suitable material within the scope of this invention. In this embodiment, the bushing 42 extends through an upper collar portion 47 of a support rib 46. A pair of machine screws 52*a*, 52*b* is threaded through the upper collar portion 47 of the support rib 46 and seat in a pair of dimples (not labeled) located on the outer surface of the bushing 42. A retainer 54 is located at the bottom end of the depressable nosepiece 14 and prevents the nosepiece 14 from being pulled completely out of the bushing 42. The support rib 46 is secured to the spring tube 30 via a machine screw 50 that is passed through a lower collar portion 48 of the support rib 46. When the depressable nosepiece 14 is depressed, the inner surface 44 of the depressable nosepiece 14 comes into contact with the spring 32. Since the spring 32 is held captive within the spring tube 30 by the stationary nosepiece 16, the spring 32 becomes compressed as the depressable nosepiece 14 is pressed against the spring 32. It should be understood that the spring 32 is replaceable so that springs of varying spring constants could be placed within the spring tube 30. In this way, one could modify the device 10 to be used for players of varying strength or for different applications, for example ballcarrying (lighter spring) or weight-training (heavier spring) applications. In alternative embodiments, the tension of the spring 32 could be adjustable so that the amount of force necessary to depress the depressable nosepiece 14 a particular distance could be modified without replacement of the spring 32.

In this embodiment, the body 12 also comprises a number of support ribs 56 molded therein to provide additional support to the body 12. A pair of battery compartments 58*a*, 58*b* molded into the body 12 house a pair of batteries 60*a*, 60*b*, which in this embodiment are standard 9-volt batteries. A piezo compartment 62 molded into the body 12 houses a piezo (alarm) 64, which comprises an indicator element that is capable of providing a perceivable indication in the form of an audible alarm or tone. First and second microswitches (snap action switches) 66, 68 are provided near the first end 20 of the body 12 located at least partially below the depressable nosepiece 14, and are wired to the batteries 60*a*, 60*b* and piezo 64, as will be described in further detail below. In this embodiment, the microswitches 66, 68 are Model No. D3V-1G-2C25 hinge lever model microswitches made by Omron Corporation of Kyoto, Japan. Other suitable microswitches may also be used, as will be appreciated by those having ordinary skill in the art.

In this embodiment, the microswitches 66, 68 are located next to each other on one side of the depressable nosepiece 14. In alternate embodiments, the microswitches 66, 68 could be located on opposing sides of the depressable nosepiece 14 in order to provide improved weight distribution within the device 10. In further alternate embodiments, counterweights could be provided in the vicinity of the stationary nosepiece 16 that act to counterbalance the weight of the microswitches 66, 68, thereby providing weight balancing to the device 10.

Figure 4:
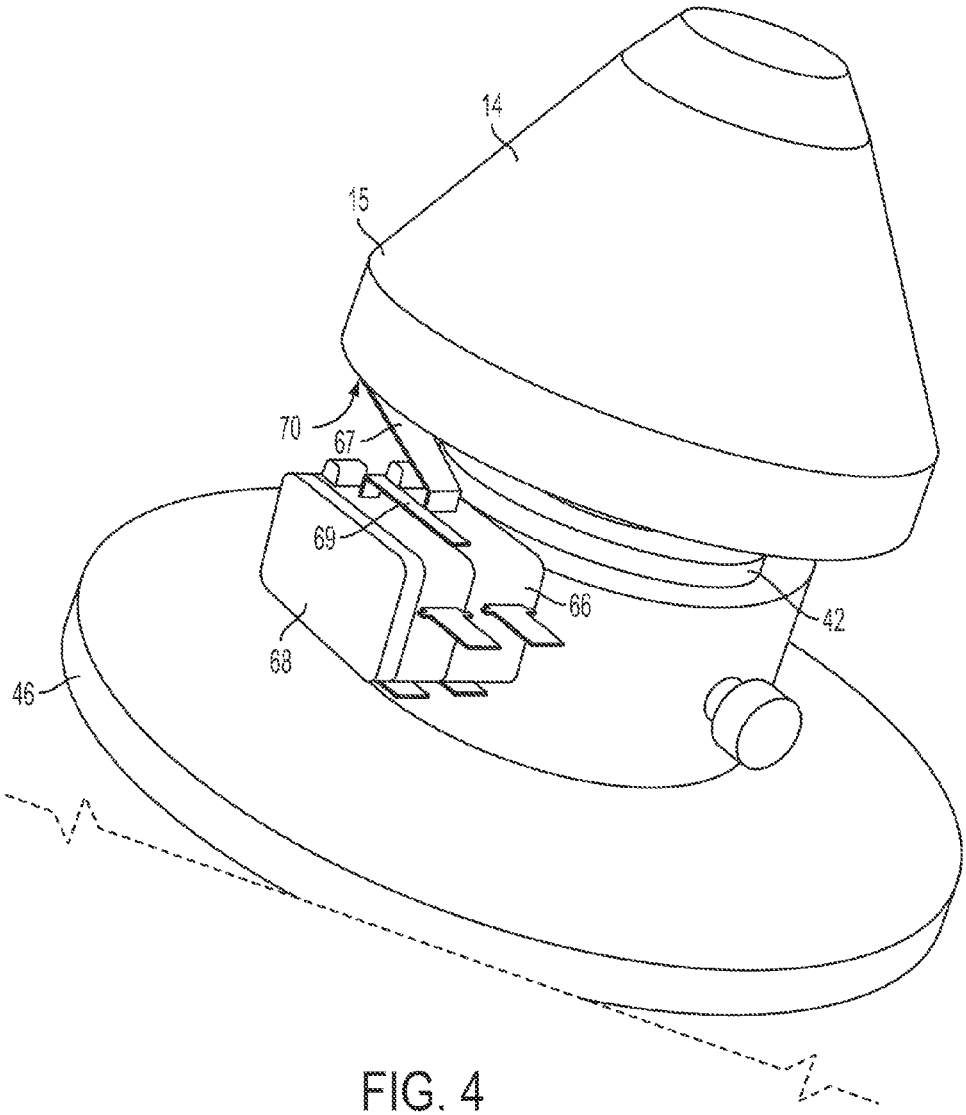
FIG. 4 is a close-up view of the placement and operation of the depressable nosepiece and microswitches of the embodiment of FIG. 1.

FIG. 4 shows a close-up view of the microswitches 66, 68 in relative placement to the depressable nosepiece 14. For purposes of clarity only, all connecting wires are omitted in FIG. 4. As best seen in FIG. 4, the first microswitch 66 has an external lever 67, and the second microswitch 68 has an external lever 69. The external lever 67 of the first microswitch 66 is bent upwardly so that, when the depressable nosepiece 14 is in its undepressed position (as shown in FIGS. 1 and 2), the lower surface 70 of the head 15 of the depressable nosepiece 14 is not in contact with the external lever 67, but is in close proximity thereto (approximately ⅛ to 3/16 of an inch apart). The external lever 69 of the second microswitch 68 is unbent, approximately parallel to the lower surface 70 of the head 15 of the depressable nosepiece 14, and located approximately 5/16 of an inch from the lower surface 70 of the head 15 of the depressable nosepiece 14 when the depressable nosepiece 14 is in its undepressed position.

In this embodiment, the first microswitch 66 is normally open, and the second microswitch 68 is normally closed. While the training device 10 is not being used or is only being held casually, the depressable nosepiece 14 will be depressed less than a first distance from the undepressed position, so that the lower surface 70 of the head 15 of the depressable nosepiece 14 does not yet come into contact with the external lever 67 of the first microswitch 66. In this configuration, as shown in the schematic wiring diagram of FIG. 5A, the piezo 64 does not sound because a circuit 72 formed between the batteries 60*a*, 60*b*, piezo 64, and microswitches 66, 68 is in an open position. During this phase, the amount of force that is being applied to the depressable nosepiece 14 along the major axis 18 is less than a first force, which is the minimum amount of force that is required to compress the spring 32 sufficiently so that the lower surface 70 of the head 15 of the depressable nosepiece 14 comes into contact with the external lever 67 of the first microswitch 66. In some embodiments, the first force is equal to at least 1 pound. It should be understood that the first force could be greater or less than 1 pound, for example 0.1-1.0 pounds or between 1-5 pounds.

Figure 5A:
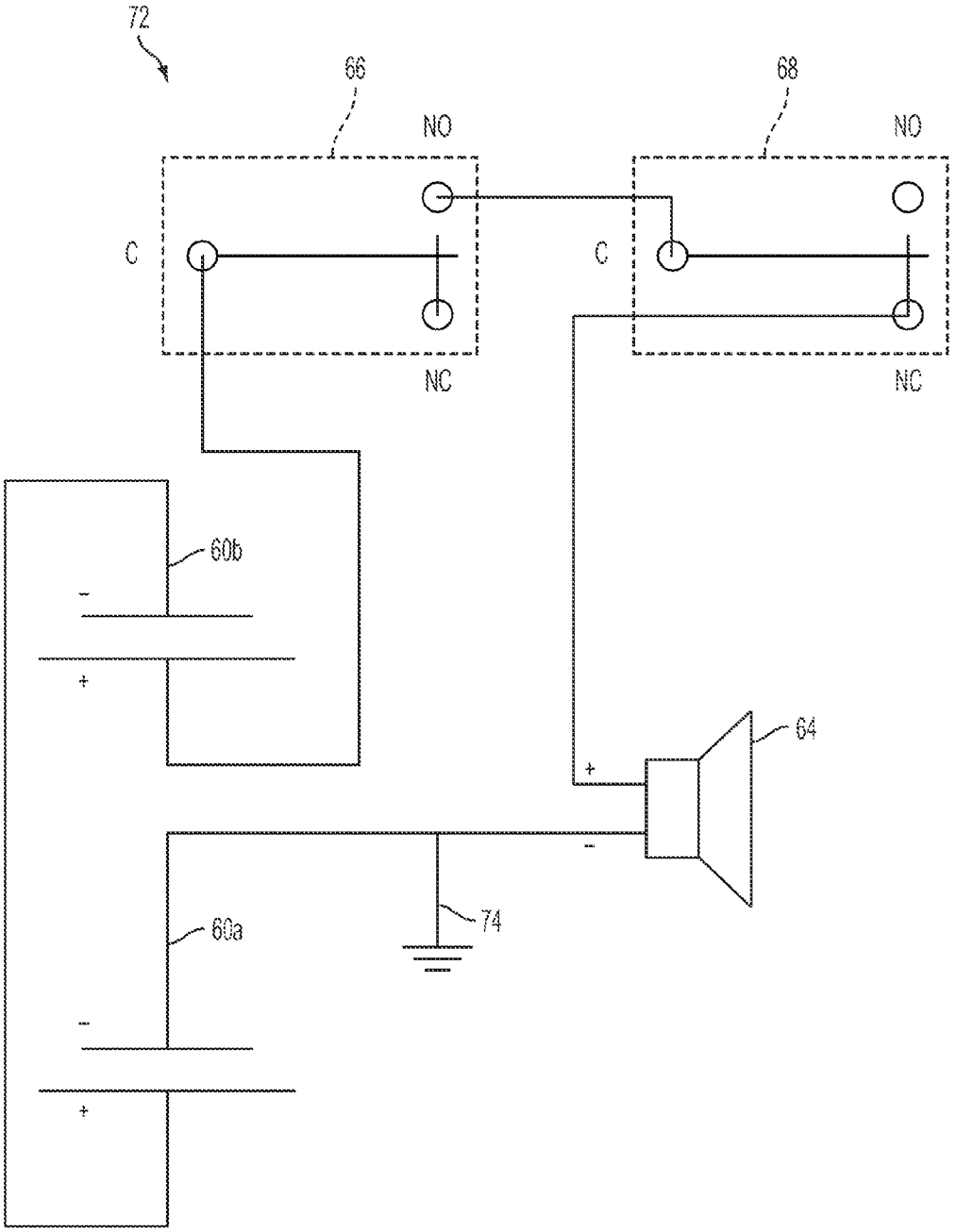
FIGS. 5A-5C show exemplary circuit diagrams for the embodiment of FIG. 1 when the depressable nosepiece is in different positions with relation to the microswitches.
Figure 5B:
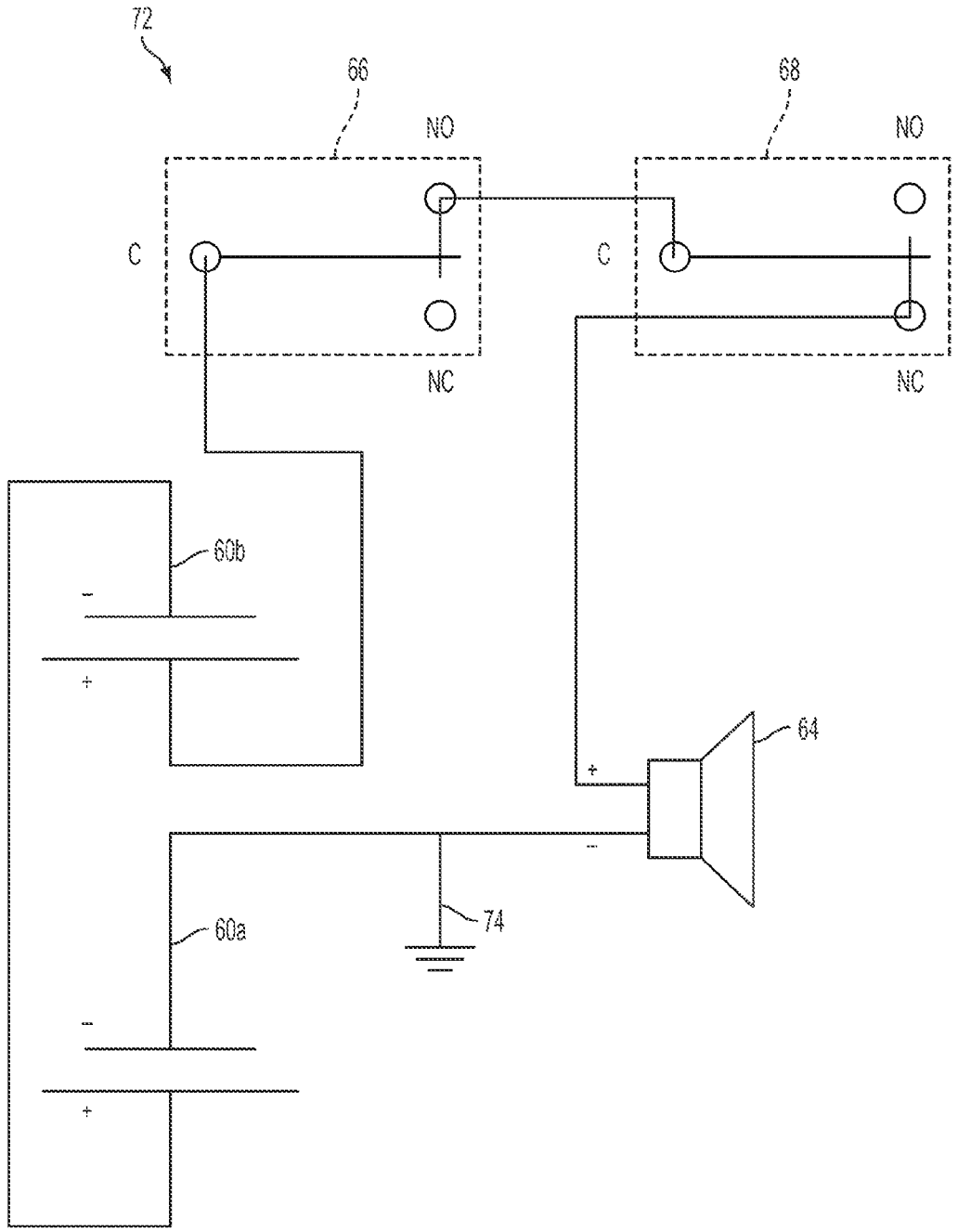

While the depressable nosepiece 14 is being depressed at least a first distance from the undepressed position (i.e., so that the lower surface 70 of the head 15 of the depressable nosepiece 14 is in contact with the external lever 67 of the first microswitch 66) but less than a second distance from the undepressed position (i.e., so that the lower surface 70 of the head 15 of the depressable nosepiece 14 has not yet come into contact with the external lever 69 of the second microswitch 68), the circuit 72 becomes closed (as shown in FIG. 5B) so that the piezo 64 provides a perceivable indication in the form of an audible alarm. This will indicate to the ballcarrier that the grip on the training device 10 (which corresponds with the amount of depressing force that is then being applied to the spring 32 via the depressable nosepiece 14 along the major axis 18) is inadequate. While the piezo 64 is sounding, the amount of depressing force being applied to the depressable nosepiece 14 along the major axis 18 is equal to or greater than the first force and less than a second force, which is the minimum amount of force that is required to compress the spring 32 sufficiently so that the lower surface 70 of the head 15 of the depressable nosepiece 14 comes into contact with the external lever 69 of the second microswitch 68. In some embodiments, the second force is equal to at least 8 pounds. It should be understood that the second force could be equal to any amount of force that is suitable for the particular user and application. For very young players just learning to carry a football, the second force could be set at less than 8 pounds, for example between 2-8 pounds. For collegiate and professional players, the second force could be set at between 8-40 pounds, for example 30 pounds for ballcarrying applications, or in a range between 40-80+ pounds for weight-training applications.

Figure 5C:
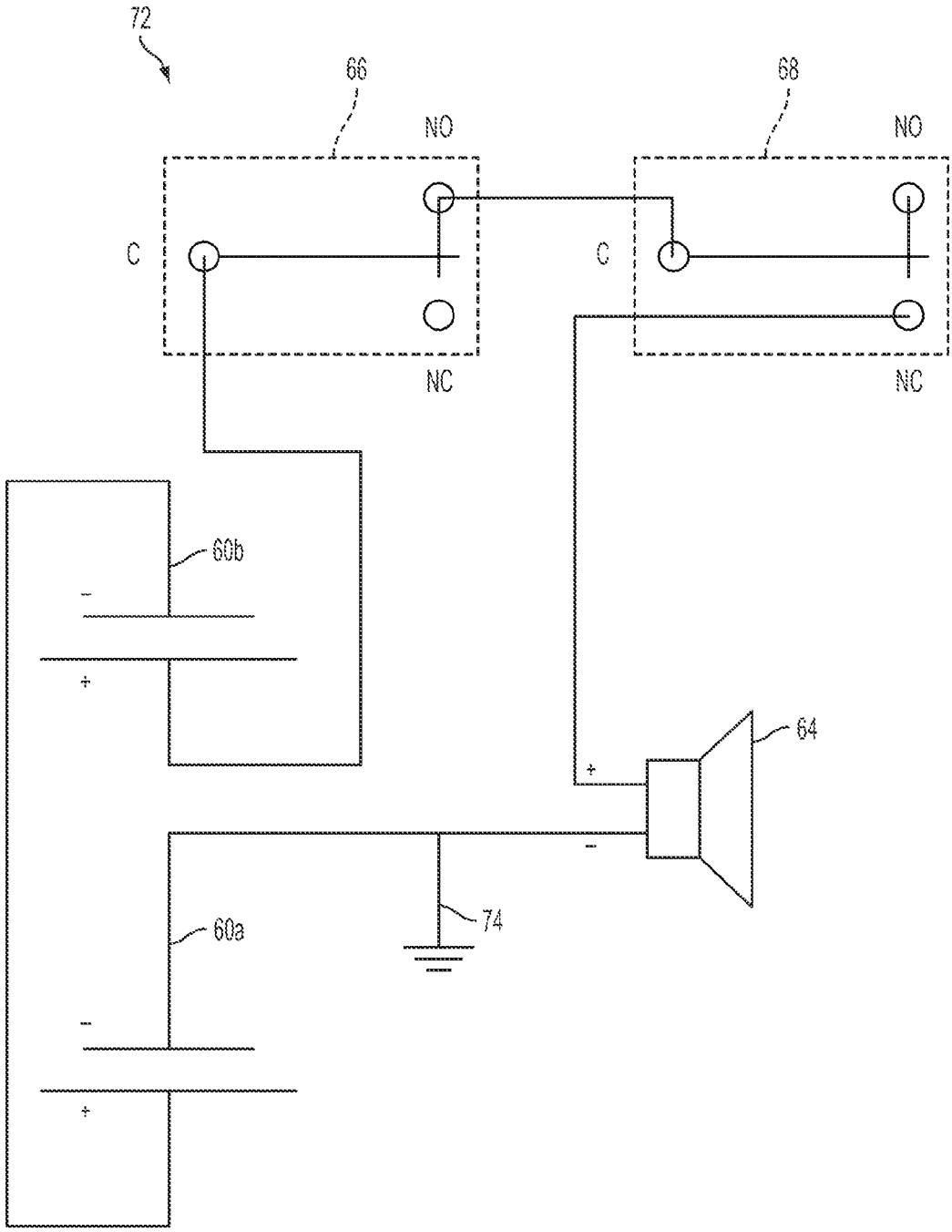

While the depressable nosepiece 14 is being depressed at least a second distance from the undepressed position (i.e., so that the lower surface 70 of the head 15 of the depressable nosepiece 14 is in contact with the external lever 69 of the second microswitch 68), the circuit 72 opens again (as shown in FIG. 5C) so that the piezo 64 no longer provides a perceivable indication to the ballcarrier. The lack of a perceivable indication communicates to the ballcarrier that they are applying an adequate amount of force to the depressable nosepiece 14 along the major axis 18, and therefore that they are supplying an adequate grip to the training device 10.

As seen in FIGS. 5A-5C, the circuit 72 comprises the batteries 60*a*, 60*b*, which are electrically connected in series to deliver, in this embodiment, 18 volts to the piezo 64 when the circuit 72 is closed as in FIG. 5B. The positive terminal of the second battery 60*b* is electrically connected to the common terminal C of the first microswitch 66. The "normally open" terminal NO of the first microswitch 66 is electrically connected to the common terminal C of the second microswitch 68. The "normally closed" terminal NC of the second microswitch 68 is electrically connected to the positive terminal of the piezo 64. The negative terminal of the piezo 64 is electrically connected to the negative terminal of the first battery 60*a* to provide a ground 74 therebetween and complete the wiring of the circuit 72.

Because the spring 32 is a resilient element, when the depressable nosepiece 14 is not being depressed, the spring 32 has a tendency to automatically return the adjacent depressable element (depressable nosepiece 14) to its undepressed position. Therefore, when the ballcarrier loosens their grip on the training device 10 such that the amount of force being applied to the depressable nosepiece 14 along the major axis 18 becomes less than the second force, the spring 32 will tend to return the depressable nosepiece 14 towards its undepressed position, thereby completing the circuit 72 such that the perceivable indication will be provided to the ballcarrier (so long as the depressing force remains greater than or equal to the first force). In this way, the ballcarrier becomes conditioned to consistently provide an adequate amount of force along the major axis 18 of the training device 10. Consequently, when the ballcarrier has an actual ball in his arm in an in-game situation, theoretically he will be conditioned to hold the ball more securely in his ballcarrying arm via the muscle memory developed while using the training device 10 according to the present invention.

In this embodiment, the perceivable indication is an audible alarm generated by the piezo 64 while the circuit 72 is closed. In alternate embodiments, the perceivable indication could be a vibration, electric shock, light, or any other indicator that is perceivable by a human sense. For example, in some embodiments an LED light could be wired in a circuit in a similar way to how the piezo 64 is wired in circuit 72, so that the LED light is off when the circuit is open, and on when the circuit is closed. In further alternate embodiments, the perceivable indication may comprise more than one perceivable indication, for example an audible alarm coupled with a vibration or light.

It will be appreciated that the foregoing is presented by way of illustration only, and not by way of any limitation, and that various alternatives and modifications may be made to the illustrated embodiments without departing from the spirit and scope of the present invention.

The invention claimed is:

1. A training device comprising:

a body having a prolate spheroid shape, the body comprising a depressible element and an indicator element, the depressible element having an undepressed position and a plurality of depressed positions into which the depressible element can be depressed wherein the indicator element is operationally configured to provide a perceivable indication while the depressible element is being depressed to a first position of the plurality of depressed positions that is located equal to or greater than a first distance from the undepressed position and less than a second distance from the undepressed position, the second distance being greater than the first distance;

wherein the indicator element does not provide the perceivable indication while the depressible element is being depressed to a second position of the plurality of depressed positions that is located less than the first distance from the undepressed position; and wherein the indicator element does not provide the perceivable indication while the depressible element is being depressed to a third position of the plurality of depressed positions that is located equal to or greater than the second distance from the undepressed position.

2. The training device of claim 1, wherein the perceivable indication is an audible alarm.

3. The training device of claim 1, wherein the perceivable indication is a vibration.

4. The training device of claim 1, wherein when the depressible element is not being depressed, the depressible element automatically returns to the undepressed position.

5. The training device of claim 1, wherein the depressible element comprises a spring.

6. The training device of claim 1, wherein the body has a major axis corresponding with a maximum axial length of the prolate spheroid shape, and the depressible element is coaxially aligned with the major axis.

7. The training device of claim 1, wherein the body is in the approximate shape of a ball commonly used in the game of American football.

8. The training device of claim 1, wherein the body has a major axis corresponding with a maximum axial length of the prolate spheroid shape, the body further comprising a first nosepiece located at one end of the major axis and a second nosepiece located at an opposing end of the major axis, wherein one of the first nosepiece and the second nosepiece is moveable and the other of the first nosepiece and the second nosepiece is stationary.

9. A training device comprising:

a body having a prolate spheroid shape, the body comprising a depressible element and an indicator element, the depressible element having an undepressed position and a plurality of depressed positions into which the depressible element can be depressed;

wherein the indicator element is operationally configured to provide a perceivable indication while the depressible element is being depressed to a first depressed position that is located equidistant with or further than a first distance from the undepressed position and less than a second distance from the undepressed position, wherein the first distance is greater than zero and the second distance is greater than the first distance; and wherein the indicator element does not provide the perceivable indication while the depressible element is being depressed to a second depressed position that is located equidistant with or further than the second distance from the undepressed position.

10. The training device of claim 9, wherein the perceivable indication is an audible alarm.

11. The training device of claim 9, wherein the perceivable indication is a vibration.

12. The training device of claim 9, the body having a major axis corresponding with a maximum axial length of the prolate spheroid shape, wherein the depressible element is coaxially aligned with the major axis.

13. The training device of claim 9, wherein when the depressible element is not being depressed, the depressible element automatically returns to the undepressed position.

14. The training device of claim 9, the body having a major axis corresponding with a maximum axial length of the prolate spheroid shape, the body further comprising a first nosepiece located at one end of the major axis and a second nosepiece located at the other end of the major axis, wherein one of the first nosepiece and the second nosepiece is moveable and the other of the first nosepiece and the second nosepiece is stationary.

15. A training device comprising:

a body having a prolate spheroid shape, the body comprising a depressible element, an indicator element, and a major axis corresponding with a maximum axial length of the prolate spheroid shape, the depressible element being coaxially aligned with the major axis and having an undepressed position and a plurality of depressed positions into which the depressible element can be depressed, the indicator element being operationally configured to provide a perceivable indication;

wherein while a depressing force is being applied to the depressible element along the major axis, the indicator element provides the perceivable indication while the depressing force has a value that is equal to or greater than a value of a first force and less than a value of a second force, the value of the second force being greater than the value of the first force;

wherein the indicator element does not provide the perceivable indication while the depressing force has a value that is less than the value of the first force; and wherein the indicator element does not provide the perceivable indication while the depressing force has a value that is equal to or greater than the value of the second force.

16. The training device of claim 15, wherein the value of the first force is equal to at least 1 pound of pressure and the value of the second force is equal to at least 8 pounds of pressure.

17. The training device of claim 15, wherein the perceivable indication is an audible alarm.

18. The training device of claim 15, wherein the perceivable indication is a vibration.

19. The training device of claim 15, wherein the depressible element comprises a spring.

20. The training device of claim 15, the body further comprising a first nosepiece located at one end of the major axis and a second nosepiece located at an opposing end of the major axis, wherein one of the first nosepiece and the second nosepiece is moveable and the other of the first nosepiece and the second nosepiece is stationary.

* * * * *